US005277508A

United States Patent [19]

Gueret

[11] Patent Number: 5,277,508

[45] Date of Patent: Jan. 11, 1994

[54] APPLICATOR FOR A PASTRY PRODUCT AND METHOD OF MAKING SAME

[75] Inventor: Jean-Louis H. Gueret, Paris, France

[73] Assignee: L'Oreal, Paris, France

[21] Appl. No.: 707,663

[22] Filed: May 30, 1991

[30] Foreign Application Priority Data

Jun. 7, 1990 [FR] France ..... 90 07073

[51] Int. Cl.[5] ..... A45D 40/06; A45D 40/12

[52] U.S. Cl. ..... 401/87; 401/68; 401/78

[58] Field of Search ..... 401/87, 78, 75, 68, 401/186; 248/309.3, 205.9, 363

[56] References Cited

U.S. PATENT DOCUMENTS

| | | | |
|---|---|---|---|
| 1,283,307 | 10/1918 | Rich | 401/87 X |
| 2,345,315 | 3/1944 | Anderson . | |
| 2,369,341 | 2/1945 | Donegan . | |
| 2,402,072 | 6/1946 | Nehrke . | |
| 2,573,452 | 10/1951 | Klippert . | |
| 2,678,128 | 5/1954 | Sherman . | |
| 2,891,348 | 6/1959 | Blage | 248/309.3 |
| 3,310,168 | 3/1967 | Landen | 401/78 X |
| 3,375,056 | 3/1968 | Rosan | 401/186 |
| 3,443,874 | 5/1969 | Pelli et al. | 401/68 X |
| 3,669,323 | 6/1972 | Harker et al. | 401/186 X |
| 4,108,558 | 8/1878 | Radice et al. | 401/78 |
| 4,545,696 | 10/1985 | Carluccio | 401/75 X |
| 4,813,801 | 3/1989 | Cardia | 401/78 X |
| 4,890,944 | 1/1990 | Cousins et al. | 401/75 X |

FOREIGN PATENT DOCUMENTS

| | | | |
|---|---|---|---|
| 1314002 | 11/1962 | France . | |
| 2797811 | 4/1952 | Switzerland . | |
| 1133527 | 3/1967 | United Kingdom | 401/78 |

*Primary Examiner*—Steven A. Bratile

*Attorney, Agent, or Firm*—Cushman, Darby & Cushman

[57] ABSTRACT

An applicator for a pasty product in stick form having a longitudinal axis and a base and a lateral face and a movable cup serving as a stick-holder with a cup having an internal lateral face and a bottom portion; the method of manufacture comprises inserting the base of the stick into the cup which has a closed peripheral side wall and an opening for allowing the escape of air upon insertion of the base of the stick into the cup which opening is subsequently closed.

5 Claims, 2 Drawing Sheets

APPLICATOR FOR A PASTRY PRODUCT AND METHOD OF MAKING SAME

FIELD OF THE INVENTION

The invention relates to a process for obtaining a device for the application of a retractable bar or stick of a pasty product, especially a cosmetic product, such as lipstick, and also to the device obtained in this manner.

DESCRIPTION OF THE PRIOR ART

Devices of this kind are already known, inter alia in the form of a case comprising a mechanism for bringing the stick out of the case and returning it into the case, a cap then being placed thereon in order to close the case.

These known devices comprise a cup forming a stick-holder having a tubular portion closed by a bottom portion and in which there is housed an end portion of the stick forming a base.

The cup is mounted so that it can slide along a longitudinal axis so that at least part of the stick can emerge from and then return into the case.

The stick is generally forced into the cup which comprises holes in its bottom portion in order to prevent the stick from sliding to and fro when it is inserted into the cup.

According to this method of fixing, the stick adheres to the inner faces of the cup, but this adherence is relatively weak and does not prevent the risk of the stick being separated from the cup.

The stick may also be forced into a cup comprising an elastic undercut engaging with the stick. However, this engagement constitutes a fragile zone which may lead to breaking of the stick as a result of bending forces when it is applied, through friction of its end opposite its base end.

SUMMARY OF THE INVENTION

The principal object of the invention is to find a process for fixing the stick to the cup which does not have the disadvantages described hereinabove and which consequently results in a device for the application of a pasty product in the form of a stick in which the said stick is firmly fixed to the cup without being made fragile as a result of the fixing means used.

The solution to this problem offered by this invention consists essentially in confining the base of the stick in a sealed manner in the cup, so that any movement by the stick out of the cup is effected in the manner of a piston in a cylinder, this piston initially being in contact with the base of the cylinder or in the immediate vicinity thereof and defining together with this base a closed chamber having an air volume close or equal to zero.

Therefore, even a slight movement of the piston not only causes an increase in the volume of the said chamber, but also creates a strong negative pressure in the latter. This negative pressure creates a force returning the piston towards the said wall.

In this manner, the base of the stick is fixed to the bottom of the cup, a return force developing as the base tends to move away from the bottom of the cup.

This invention relates more precisely to a process for obtaining a device for the application of a pasty product, especially a cosmetic product, such as lipstick, comprising, on the one hand, a stick or bar of the said product, allowing for a longitudinal axis and comprising a base having a lateral face and an end face and, on the other hand, a cup forming a stick-holder mounted so that it can slide along the said longitudinal axis and having a tubular portion having an inner lateral face defined by a bottom portion, the cup receiving the base of the stick in such a manner that, on the one hand, the said lateral faces and, on the other hand, the end face and the bottom portion are opposite one another, this process comprising the following stages, according to which:

a) the cup is adapted so that its inner lateral face has a closed contour in section through a plane orthogonal to the said axis, b) the base of the stick is inserted into the cup, a leak having been created in order to allow the air contained in the said cup to escape and to be replaced by the base of the stick, this process being characterised in that it moreover comprises a stage c) according to which the escape of air is suppressed at least in the direction from the exterior towards the interior, thereby confining the base of the stick in a sealed manner in the cup.

In this manner, therefore, the base of the stick is fixed to the bottom of the cup by a return force added to the adherence of the stick to the inner walls of the cup.

In a variant of this process, the cup is adapted so that its bottom is closed in a sealed manner, the stick used is such that its base, at ambient temperature, in section through a plane orthogonal to the said longitudinal axis, has a contour of dimensions greater than or equal to the said closed contour of the cup, and it is cooled to a temperature lower than ambient temperature in order to reduce the dimensions of its base by contraction to values lower than the corresponding inner values of the cup, so as to create the said leak between the base of the stick and the cup, the base of the stick is inserted into the cup by means of this contraction, the stick is allowed to return to ambient temperature in the cup, thereby suppressing the leak by expansion of the base of the stick in the cup.

This variant has the advantage of preventing the stick from sliding to and fro when it is inserted into the cup. In addition, it is possible to tension the stick in the cup by the expansion thereof. This tension considerably increases the adherence of the stick to the cup.

In another preferred variant of the process according to the invention, the said process comprises the following stages:

the leak is created by adapting the cup so that its bottom portion comprises a leakage hole, the stick used is such that its base has dimensions at least equal to the inner dimensions of the cup, the base of the stick is inserted into the cup, the said base then forming a piston driving the air out through the said hole, this process being characterised in that it moreover comprises a stage according to which the said hole is closed in a sealed manner by a sealing means, thereby suppressing the leak. The sealing means may be any known means for the sealed closure of a hole, inter alia a plug, a self-adhesive label or a weld.

In another even more preferred variant, the leak is created by adapting the cup so that its bottom portion comprises a leakage hole comprising an air non-return valve towards the interior of the cup, the stick used is such that its base has dimensions at least equal to the inner dimensions of the cup, the base of the stick is inserted into the cup, the said base then forming a piston driving the air out in a unidirectional manner through the valve means. This variant is particularly advantageous as it makes it possible to dispense with the additional stage described hereinabove of sealing the hole. Moreover, it makes it very simple to position and fix the stick in the cup.

This invention also relates to a device that can be obtained by the above process, more precisely a device for the application of a pasty product, especially a cosmetic product, such as lipstick, and comprising, on the one hand, a stick or bar of the said product, allowing for a longitudinal axis and comprising a base having a lateral face and an end face and, on the other hand, a cup forming a stick-holder mounted so that it can slide along the said longitudinal axis and having a tubular portion having an inner lateral face defined by a bottom portion, the cup receiving the base of the stick in such a manner that, on the one hand, the said lateral faces and, on the other hand, the end face and the bottom portion are opposite one another, characterised in that the bottom of the cup is sealed and that the said lateral face of the cup, on the one hand, has a closed contour in section through a plane orthogonal to the said longitudinal axis and, on the other hand, enters into sealing contact with the lateral face of the stick.

The end face of the stick is advantageously in contact with the bottom of the cup or in the immediate vicinity thereof. This arrangement has the advantage of giving a zero volume or a very small volume to the chamber formed between the base of the stick and the bottom of the cup, and, consequently, of obtaining a return force increasing very rapidly with any movement of the stick out of the cup.

The entire inner lateral face of the cup is preferably in sealing contact with the lateral face of the base of the stick. The object of this arrangement is to maximise the extent of the seal produced by the contact of the lateral face of the base of the stick and the inner lateral face of the cup and therefore to make it more difficult to break this seal.

In a particular embodiment, the inner lateral face of the cup is generally in the shape of a cylinder generated by rotation about the longitudinal axis and comprises a connection zone to the bottom portion, this zone forming a truncated chamfer tapering towards the said bottom portion. This arrangement has the advantage of tensioning an end zone of the base opposite the said bottom portion of the cup, thereby ensuring improved sealing of the closed chamber.

In a particular embodiment, the bottom of the cup is closed and extends in one piece. This cup is then used in the variant of the process requiring cooling of the stick of the product.

The cup may comprise longitudinal projections in the axial direction over the inner lateral wall of the cup, serving to increase the resistance of the stick.

According to a preferred variant of the device, the bottom of the cup has a leakage hole sealed by a sealing means. By virtue of this arrangement, it is possible to mount and fix the stick in the cup in a particularly simple manner, the cup being positioned in the device.

According to a variant embodiment, the cup comprises on the side of the stick grooves converging towards the said hole and opening into the latter. These grooves serve to collect the air trapped between the end face of the base of the stick and the bottom of the cup.

The said leakage hole advantageously narrows into the bottom portion towards the side of the stick. This arrangement makes it possible in particular to create a cavity to receive a plug of a setting liquid or a hot-melt adhesive.

The bottom of the cup advantageously comprises on its side opposite to that opposite the stick a projection traversed by the said leakage hole. This projection has the advantage of bringing one of the orifices of the said leakage hole closer to one of the ends of the device for improved access to the said hole in order to facilitate sealing thereof.

In an even more preferred embodiment of the device, the bottom of the cup has a leakage hole consisting of an air non-return valve means towards the interior of the cup. By virtue of this device, when the stick is mounted in the cup, it is possible, when the base of the stick is inserted into the cup, to obtain evacuation of the air and instantaneous fixing of the stick to the cup.

The expression air non-return valve means refers to any air non-return valve opening under a small negative pressure in the direction of the air escaping from the interior of the cup towards the exterior and then remaining spontaneously closed when the pressure of the external air is equal to or greater than the pressure existing in the said chamber formed in the cup.

In a preferred embodiment, when the cup comprises a leakage hole, the device comprises in combination:

an inner sleeve comprising a bottom portion and in the interior of which the cup is slidably mounted, an outer sleeve mounted to rotate coaxially about the inner sleeve, a tubular base fixed in rotation to the inner sleeve and comprising a bottom portion supported by the bottom portion of the inner sleeve, the said tubular base being associated with the outer sleeve in order to form the outer casing of the device, the bottom portions of the inner sleeve and the base being traversed by aligned bores opening into the interior of the inner sleeve and thereby allowing for access from the exterior of the device to the leakage hole formed in the bottom of the cup. This particular arrangement allows for simple mounting of the stick in the device, as, in a first stage, the cup is disposed at the open end of the inner sleeve. The base of the stick is then inserted into the cup, the air escaping through the leakage hole into the interior of the inner sleeve. The cup is then placed at the other end of the device, thereby allowing for easy access from the exterior to the leakage hole formed in the bottom of the cup. This hole is then sealed by a sealing means. The bore of the base is then concealed by a cover or a small plate.

BRIEF DESCRIPTION OF THE INVENTION

The object of the invention will be more readily understood from the following description of several embodiments, given purely by way of non-limiting examples and illustrated in the accompanying drawings, in which.

Figure 3:
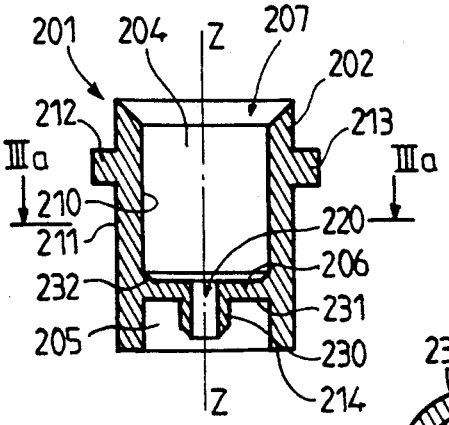
FIG. 3 shows a third embodiment of the cup according to the invention, viewed in section through a plane passing through the longitudinal axis of the cup.
Figure 3A:
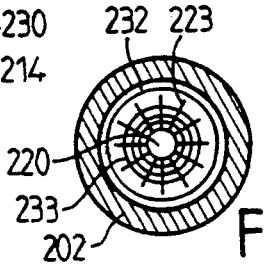
Figure 5:
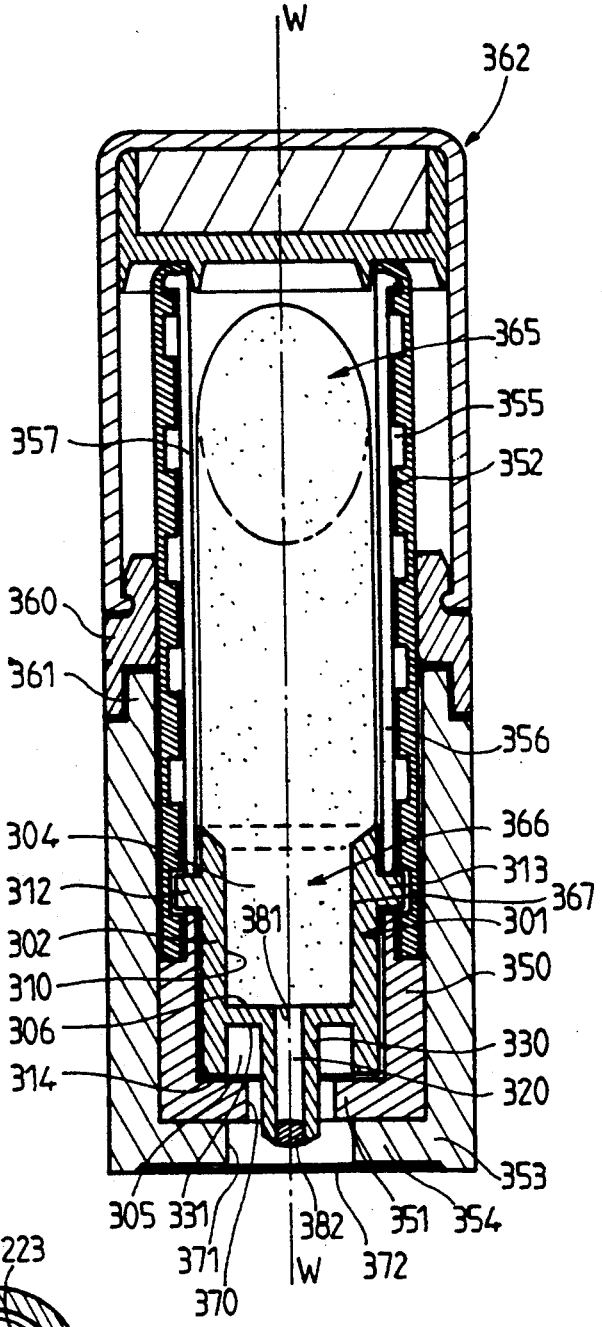
Figure 6:
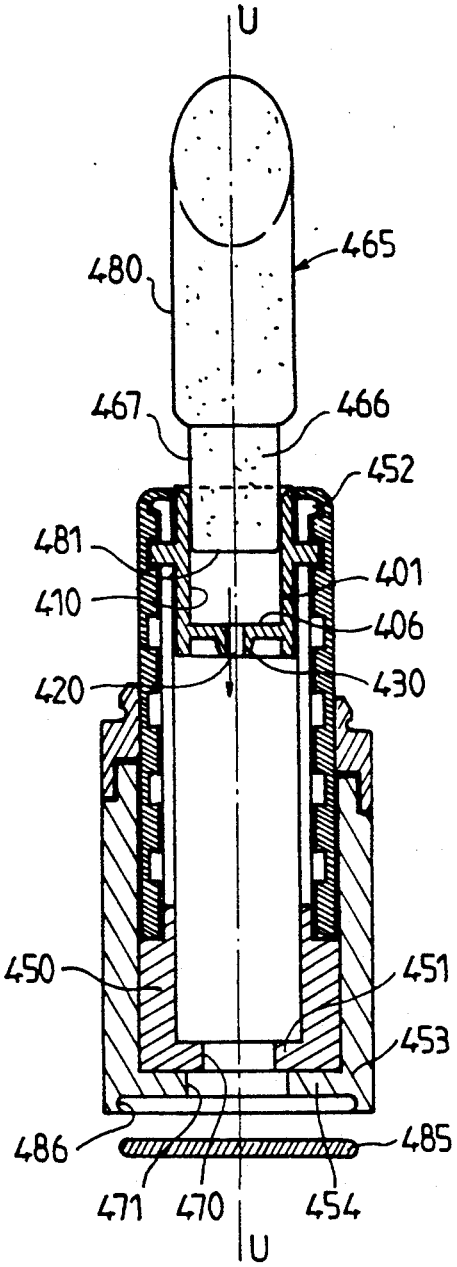
Figure 7:
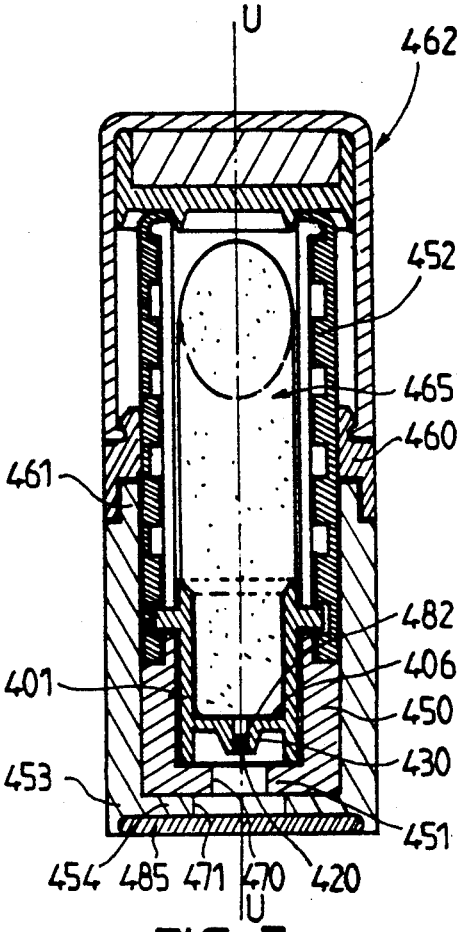
Figure 4:
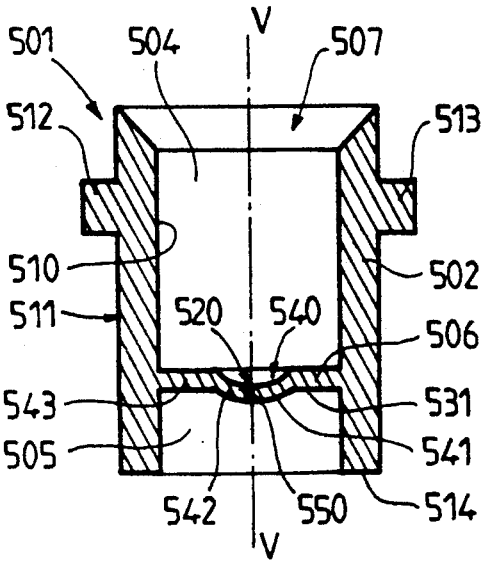

FIG. 3*a* shows a view along the line III*a*—III*a* of FIG. 3;

FIG. 4 shows a fourth embodiment of the cup according to the invention, viewed in section through a plane passing through the longitudinal axis of the cup;

FIG. 5 shows a longitudinal section of a device according to this invention, comprising a cup, the bottom portion of which has a sealed leakage hole;

FIG. 6 shows a longitudinal section of a device according to this invention provided with a cup slid to a first end of the device, and FIG. 7 shows a longitudinal section of the same device as in FIG. 6, covered with its cap and in which the stick has been fixed in the cup.

DETAILED DESCRIPTION OF THE INVENTION

Figure 1:
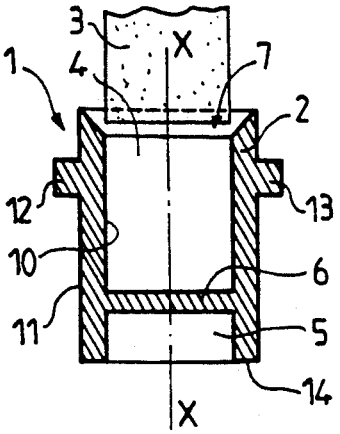
FIG. 1 shows a first embodiment of the cup according to the invention, viewed in section through a plane passing through the longitudinal axis of the cup, a stick base about to be inserted into the cup.

FIG. 1 shows a cup designated in general by the reference numeral 1. This cup comprises a tube 2 in the shape of a cylinder generated by rotation about the longitudinal axis X—X. A flat closed bottom portion 6 divides the tube into an upper compartment 4 and a lower compartment 5. The upper compartment 4 has a height greater than that of the compartment 5 and they are both open towards the exterior. The upper compartment 4 is adapted to receive the base 3 of the stick of the pasty product to be applied. The bottom portion 6 is formed in one piece and divides the compartments 4 and 5 in a sealed manner. The upper compartment 4 of the cup 1 forming a stick-holder comprises an inner cylindrical lateral face 10 defined by the bottom portion 6. This lateral face 10 has a closed contour in section through a plane orthogonal to the said axis X—X, in this case a circle having a constant diameter irrespective of the position of the orthogonal plane intersecting the lateral face 10. In other embodiments which are not shown, the closed contour may have other shapes, inter alia, oval or polygonal. In these embodiments, the closed contour is substantially the same irrespective of the position of the plane of intersection. Therefore, longitudinal translation of the base of the stick relative to the cup does not result in a loss of sealing contact between the lateral face of the base and the inner lateral face of the cup. The tube 2 moreover comprises an outer cylindrical face 11 extending along the entire length of the tube 2. This outer cylindrical face of the tube comprises at the upper compartment 4 two pins 12 and 13 diametrically opposite to the axis X—X. These pins are adapted to cooperate with helical grooves and sliding surfaces (not shown) of the said device. The tube 2 has a lower edge 14 forming a circular ring. The tube 2 has an upper chamfered edge 7 widening towards the exterior in order to facilitate the insertion of the stick into the cup. This upper edge 7 has the shape of a truncated cone generated by rotation about the axis X—X, the cone tapering towards the interior of the tube.

In order to insert the base 3 of the stick into the cup 1, a stick is first selected, the base of which may assume a complementary shape to that of the upper compartment 4 of the cup 1. In this case, the base 3 is in the shape of a cylinder generated by rotation and its diameter at ambient temperature is equal to or greater than the diameter of the upper compartment 4. The base 3 of the stick is cooled in order to contract it so that its diameter when cold is less than that of the compartment 4. The cooled base 3 is inserted into the compartment 4, the air of the cup then being driven out through the leakage hole then existing between the lateral face of the base and the inner cylindrical lateral face 10 of the compartment 4. The base 3 expands through heating and its inner lateral face comes into sealing contact with the lateral face 10 of the cup 1, thereby suppressing the leak and creating a closed chamber defined by the bottom 6 of the cup 1 and the circular end of the base 3.

Figure 2:
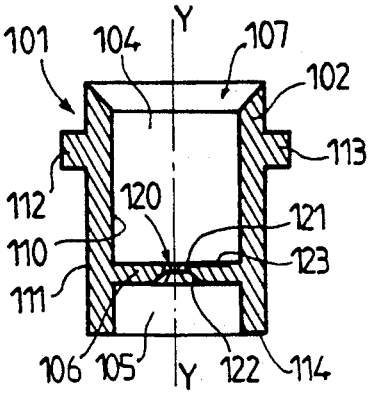
FIG. 2 shows a second embodiment of the cup according to the invention, viewed in section through a plane passing through the longitudinal axis of the cup.

FIG. 2 shows a second embodiment of the cup, in which the features analogous to those of FIG. 1 described hereinbefore comprise reference numerals increased by 100. The flat bottom portion 106 of the cup 101 comprises a leakage hole 120 centered on the axis of rotation Y—Y and passing right through the bottom portion 106, thereby bringing the upper compartment 104 into communication with the lower compartment 105 of the tube 102.

Starting from the upper compartment 104, the hole 120 comprises in succession a first portion in the form of a bore 121, this bore 121 being continued by a generally truncated portion 122 which opens into the lower compartment 105. The truncated portion 122 and the bore 121 of the hole 120 are adapted to receive a liquid which sets to form the sealing means. Fine grooves 123 extend in the compartment 104 over the bottom portion 106 of the cup in a radial projection. These grooves 123 open into the hole 120 and, more particularly, into the bore 121. The object of these grooves 123 is to facilitate the escape of the air trapped between the stick and the bottom of the cup when the stick is pushed in the direction of the bottom portion 106.

FIGS. 3 and 3*a* show a third embodiment of the cup, in which the features analogous to those of the cup of FIG. 1 have been given reference numerals increased by 200 relative to those of FIG. 1. In this embodiment, the flat bottom portion 206 of the cup comprises a projection 230 extending from the lower face 231 of the bottom portion 206 in the lower compartment 205 in the direction of a longitudinal axis Z—Z. This projection 230 surrounds the tubular hole 220, although it does not extend beyond the lower edge 214 of the tube 202. The inner lateral face 210 of the cup 201 generally in the shape of a cylinder generated by rotation about the longitudinal axis Z—Z comprises a connection zone 232 to the bottom portion 206, this zone 232 forming a chamfer in the shape of a truncated cone tapering towards the said bottom portion 206. The object of this connection zone 232 is to tension the stick when it is pushed to the bottom 206 of the cup 201 and, consequently, to ensure improved sealing between the inner lateral face 210 of the cup 201 and the lateral face of the base of the stick, not shown in this drawing. The bottom portion 206 also comprises circular throats 233 centred on the axis Z—Z and having a depth substantially identical to that of the radial grooves 223. These throats 233 together with the radial grooves 223 form a collecting system for the air to be evacuated from the cup through the hole 220 upon the insertion of the stick.

FIG. 4 shows a fourth embodiment of a cup, the structural features of which analogous to those of FIG. 3 comprise reference numerals increased by 300 relative to those of FIG. 3.

This cup comprises a hole 520 comprising an air non-return valve means in the direction from the lower compartment 505 to the upper compartment 504, the latter being adapted to receive the base of the stick.

The cup 501 is produced by moulding a plastic material having a certain elasticity at ambient temperature. This cup 501 generally in the shape of a cylinder generated by rotation about the longitudinal axis V—V comprises a bottom portion 506 dividing the tube 502 into two compartments 504, 505. The upper compartment 504 is adapted to receive the base of the stick (not shown). The bottom portion 506 comprises in the upper compartment 504 a concave face 540 generally having the shape of a spherical segment of axis V—V. This concave face 540 defines a corresponding convex face 541 projecting into the lower compartment 505. The two faces 540, 541 define between them a curved wall 542 of the bottom portion 506 of thickness smaller than that of the flat wall 543 of the bottom portion 506 included between the concave and convex portions 540, 541 and the inner lateral face 510 of the cup 501. The curved wall comprises a leakage hole 520 which is closed at rest. This hole 520 is in the form of a slot 550 formed by a very fine plate having pierced the curved wall 542 in the direction from the upper compartment 504 to the lower compartment 505. This plate is then withdrawn and, by virtue of the elasticity of the material of the cup, the slot 555 is closed again by edge-to-edge contact.

The slot 550 acts like an air non-return valve in the direction from the lower compartment 505 to the upper compartment 504. As a slight negative pressure exists in the upper compartment 504 relative to the lower compartment 505, this has a tendency to flatten the curved wall 542 and to hold the edges of the slot 550 even more tightly together and therefore to increase the sealing of the closure of the slot 550. On the other hand, in the opposite direction, a slight excess pressure of the air in the upper compartment 504 relative to the pressure prevailing in the lower compartment 505 will expand the curved wall 542 and move the edges of the slot 550 away from one another, causing it to open and air to pass from the compartment 504 to the compartment 505. In this manner, if a stick base is inserted, sliding into the compartment 504 in the direction of the bottom 506 of the cup, air will be driven out through the slot 550 by means of its opening as a result of the excess air pressure created in the compartment 504 by the thrust of the base of the stick. The base of the stick positioned near the bottom 506 of the cup 501 will be blocked in this position by the return force already mentioned hereinabove.

FIG. 5 shows a device according to this invention. This device comprises a fifth embodiment of a cup, in which the structural features analogous to the features of FIG. 3 have reference numerals increased by 100 relative to those of FIG. 3. The cup 301 is equipped with pins 312 and 313 diametrically opposite to the axis W—W. The bottom 306 of the cup comprises a hole 320 extending in a projection 330 projecting into the lower compartment 305. In this embodiment, the projection 330 extends beyond the lower edge 314 of the latter. The device comprises an inner sleeve 350 provided with a bottom portion 351 and in the interior of which the cup 301 is slidably mounted. An outer sleeve 352 is mounted to rotate coaxially about the inner sleeve 350. Two rectilinear slots 356, 357 diametrically opposite and parallel to the axis W—W are formed in the cylindrical wall of the inner sleeve 350 to serve as rectilinear sliding surfaces for the pins 312, 313. The outer sleeve 352 has a cylindrical wall provided with a helical groove 355 receiving the ends of the pins 312, 313. The cooperation of the rectilinear slots 356, 357, the helical groove 355 and the pins 312, 313 allows for an upward or downward movement of the cup 301 when the sleeves 350, 352 rotate in relation to one another about the axis of rotation W—W. A tubular base 353 is fixed in rotation to the inner sleeve 350 and comprises a bottom portion 354 which supports the bottom portion 351 of the inner sleeve. The tubular base 353 is associated with the outer sleeve 352 in order to form the outer casing of the device. A decorative ring 360 surrounds the outer sleeve 352 and rests against the upper end 361 of the tubular base 353. A movable cap 362 covers the upper part of the outer sleeve 352 coming to rest against and snapping on to the decorative ring 360. The stick 365 has a base 366 inserted into the upper compartment 304 of the cup 301. The base 366 has, on the one hand, a cylindrical lateral face 367 opposite to and in sealing contact with the inner lateral face 310 of the cup 301 and, on the other hand, an end face 381 in contact with the bottom 306 of the cup.

The bottom portions 351 and 354 respectively of the inner sleeve 350 and the tubular base 353 are traversed by aligned bores, 370 and 371 respectively, which open into the interior of the inner sleeve 350, thereby allowing for access from the exterior of the device to the leakage hole 320 formed in the bottom of the cup, as this hole 320 is extended by the projection 330, the lower end of which is at the lower edge 354 of the tubular base 353. The hole 320 is sealed at the lower end of the projection 330 by a sealed plug 382 consisting of a setting liquid. A self-adhesive cover 372 is stuck to the bottom portion 354 of the tubular base 353 to conceal the interior of the device from view.

FIGS. 6 and 7 show a device according to the invention equipped with the cup illustrated in FIG. 3. The features of this device analogous to those of FIG. 5 are designated in this case by reference numerals increased by 100 relative to those of FIG. 5. The stick 465 of longitudinal axis comprises two parts, an upper portion 480 and a lower portion forming the base 466. The upper portion has a radial section of dimensions greater than the radial section of the base 466. The latter has a cylindrical lateral face 467. FIG. 6 shows the insertion of the base sliding into the cup 401, an arrow indicating the flow direction of the air included between the end face 481 of the base and the bottom 406 of the cup. It is possible in this manner to insert the base 466 completely into the cup 401. FIG. 7 is another view of the device of FIG. 6, in which the cup 401 is displaced at the lower end of the device near the bottom portion 451 of the inner sleeve 450. The hole 420 in the bottom 406 of the cup, easily accessible by passage through bores 470 and 471 formed respectively in the bottom portion 451 of the sleeve 450 and the bottom portion 454 of the said tubular base 453 of the device, is closed in a sealed manner by a plug 482. A small circular plate 485 is snapped on by means of a circular throat 486 formed at the end of the tubular base 453 in order to conceal the bores 470 and 471 and the lower portions of the device.

A movable cap 462 is positioned and snapped on to the decorative ring 460 surrounding the outer sleeve 452 and coming to rest against the end 461 of the tubular base 453.

I claim:

1. A device for the application of a pasty product, such as lipstick, in the form of a stick or bar having a longitudinal axis and having a base, a lateral face and an end face and a cup for holding the product with the cup being mounted in said device for sliding movement along said longitudinal axis, said cup having a tubular portion and an inner lateral face having a dimension to receive the base and a portion of the lateral face of the product and a bottom portion, said cup having interior dimensions, the base of the product in a section in a plane orthogonal to said longitudinal axis having a contour of dimensions at least equal to said interior dimensions of the cup so that, on insertion of said base into said cup, said base of said product enters into sealing contact with said lateral face of said cup, said bottom portion of said cup having a leakage hole provided with a non-return valve means for allowing flow of air out of said cup.

2. The invention as claimed in claim 1 further including an inner, an outer sleeve and a tubular base, said inner sleeve having a bottom portion, said cup being slidably mounted in said bottom portion of said inner sleeve, said tubular base being fixed to said inner sleeve and having a bottom portion receiving said bottom portion of said inner sleeve, said outer sleeve being mounted to rotate coaxially about said inner sleeve and being associated with said tubular base to form an outer case for said device, said bottom portions of said inner sleeve and said tubular base having aligned through bores for allowing access to said leakage hole of said cup.

3. A process for assembling a device for the application of a pasty product, such as lipstick, in the form of a stick or bar having a longitudinal axis and having a base, a lateral face and an end face and a cup for holding the product with the cup being mounted for sliding movement along said longitudinal axis, said cup having a tubular portion and an inner lateral face having a dimension to receive the base and a portion of the lateral face of the product and a bottom portion, the steps comprising inserting the product into the cup with the base of the product facing the bottom portion of the cup while allowing the air in the cup to escape and to be replaced by the base of the product and continuing to insert the product and cutting off the escape of air to thereby confine the base of the product in a sealed manner in the cup and wherein said bottom portion of said cup has a leakage hole provided with a non-return valve means allowing flow out of the cup and the cup has interior dimensions, the base of the product in a section in a place orthogonal to said longitudinal axis having a contour of dimensions at least equal to said interior dimensions of the cup and including the step of allowing the air in the cup to escape including forcing the air through the leakage hole and non-return valve means on inserting the base of the product into the cup.

4. A device for the application of a pasty product, such as lipstick, in the form of a stick or bar having a longitudinal axis and having a base, a lateral face and an end face and a cup for holding the product with the cup being mounted in said device for sliding movement along said longitudinal axis, said cup having a tubular portion and an inner lateral face having a dimension to receive the base and a portion of the lateral face of the product and a bottom portion, said cup having interior dimensions, the base of the product in a section in a plane orthogonal to said longitudinal axis having a contour of dimensions at least equal to said interior dimensions of the cup so that, on insertion of said base into said cup, said base of said product enters into sealing contact with said lateral face of said cup, said bottom portion of said cup having a leakage hole provided with a non-return valve means for allowing flow of air out of said cup, said cup having an interior and said non-return valve means comprising a normally closed opening provided in a curved wall which projects from the side of said bottom portion facing away from said interior of said cup, said curved wall having a reduced thickness relative to the thickness of said bottom portion so that said non-return valve means will open under a slight over pressure of air in said interior of said cup.

5. A device for the application of a pasty product, such as lipstick, in the form of a stick or bar having a longitudinal axis and having a base, a lateral face and an end face and a cup for holding the product with the cup being mounted in said device for sliding movement along said longitudinal axis, said cup having a tubular portion and an inner lateral face having a dimension to receive the base and a portion of the lateral face of the product and a bottom portion, said cup having interior dimensions, the base of the product in a section in a plane orthogonal to said longitudinal axis having a contour of dimensions at least equal to said interior dimensions of the cup so that, on insertion of said base into said cup, said base of said product enters into sealing contact with said lateral face of said cup, said bottom portion of said cup having a leakage hole provided with a non-return valve means for allowing flow of air out of said cup, said leakage hole of said non-return valve means being provided in an outwardly curved wall portion provided on said bottom portion of said cup, said leakage hole being a slot capable of opening when exposed to a slight over pressure in said cup.

* * * * *